US011311919B2

(12) United States Patent
Balka

(10) Patent No.: US 11,311,919 B2
(45) Date of Patent: Apr. 26, 2022

(54) CLEANING METHOD FOR SURFACES IN THE INTERNAL VOLUME OF AIRCRAFT COMPONENTS THROUGH WHICH A MEDIUM FLOWS

(71) Applicant: Lufthansa Technik AG, Hamburg (DE)

(72) Inventor: Matthias Balka, Hamburg (DE)

(73) Assignee: LUFTHANSA TECHNIK AG, Hamburg (DE)

( * ) Notice: Subject to any disclaimer, the term of this patent is extended or adjusted under 35 U.S.C. 154(b) by 55 days.

(21) Appl. No.: 16/624,308

(22) PCT Filed: Jun. 18, 2018

(86) PCT No.: PCT/EP2018/066071
§ 371 (c)(1),
(2) Date: Dec. 19, 2019

(87) PCT Pub. No.: WO2018/234218
PCT Pub. Date: Dec. 27, 2018

(65) Prior Publication Data

US 2020/0171553 A1 Jun. 4, 2020

(30) Foreign Application Priority Data

Jun. 22, 2017 (DE) ..... 10 2017 210 554.2

(51) Int. Cl.
*B08B 9/032* (2006.01)
*F28G 9/00* (2006.01)
(Continued)

(52) U.S. Cl.
CPC ..... *B08B 9/0325* (2013.01); *B08B 9/0327* (2013.01); *F28G 9/00* (2013.01);
(Continued)

(58) Field of Classification Search
CPC ..... B08B 2230/01; F28G 2015/006; F28G 13/005
See application file for complete search history.

(56) References Cited

U.S. PATENT DOCUMENTS 5,246,633 A * 9/1993 Teng ..... F01K 9/00 261/36.1
5,287,606 A * 2/1994 Ruef ..... B08B 3/022 28/219
(Continued)

FOREIGN PATENT DOCUMENTS

CN 103267444 B 1/2015
CN 204359200 U 5/2015
(Continued)

OTHER PUBLICATIONS

Machine translation: CN206235237U (Year: 2017).*

*Primary Examiner* — Natasha N Campbell
(74) *Attorney, Agent, or Firm* — Leydig, Voit & Mayer Ltd.

(57) ABSTRACT

A method cleans surfaces in an internal volume of an aircraft component through which a medium flows. The method includes: connecting the internal volume to be cleaned to a steam generator; generating a cleaning steam having a predetermined vapour pressure and temperature by the steam generator; applying the cleaning steam to the surfaces to be cleaned in the internal volume; maintaining the vapour pressure and the temperature within the internal volume for the duration of a predetermined condensation time; generating a pressure drop in the internal volume of the aircraft component, in order to vaporise the portion of the cleaning steam that condensed during the condensation time; and removing the cleaning steam from the internal volume via a discharge device.

16 Claims, 3 Drawing Sheets

(51) Int. Cl.
*F28G 13/00* (2006.01)
*F28G 15/00* (2006.01)

(52) U.S. Cl.
CPC ..... *F28G 13/005* (2013.01); *B08B 2230/01* (2013.01); *F28G 2015/006* (2013.01)

(56) References Cited

U.S. PATENT DOCUMENTS

| | | | | |
|---|---|---|---|---|
| 6,019,819 | A * | 2/2000 | Williams | B01D 50/004 95/206 |
| 6,290,778 | B1 * | 9/2001 | Zugibe | B08B 3/12 134/1 |
| 2004/0231702 | A1 | 11/2004 | Cook et al. | |
| 2006/0169305 | A1 | 8/2006 | Jansen et al. | |
| 2008/0031602 | A1 * | 2/2008 | Baecker | A45D 19/16 392/403 |
| 2010/0288471 | A1 * | 11/2010 | Summerer | F28F 1/022 165/95 |
| 2011/0030736 | A1 * | 2/2011 | Geissler | B08B 7/00 134/30 |
| 2012/0199310 | A1 * | 8/2012 | Koenig | F28G 15/003 165/11.1 |

FOREIGN PATENT DOCUMENTS

| | | | |
|---|---|---|---|
| CN | 206235237 | U * | 6/2017 |
| DE | 102009009938 | A1 | 8/2010 |

* cited by examiner

CLEANING METHOD FOR SURFACES IN THE INTERNAL VOLUME OF AIRCRAFT COMPONENTS THROUGH WHICH A MEDIUM FLOWS

CROSS-REFERENCE TO PRIOR APPLICATIONS

This application is a U.S. National Phase Application under 35 U.S.C. § 371 of International Application No. PCT/EP2018/066071, filed on Jun. 18, 2018, and claims benefit to German Patent Application No. DE 10 2017 210 554.2, filed on Jun. 22, 2017. The International Application was published in German on Dec. 27, 2018 as WO 2018/234218 under PCT Article 21(2).

FIELD

The present invention relates to a method for cleaning surfaces in the internal volume of an aircraft component through which a medium flows.

BACKGROUND

In order to clean contamination on surfaces that are hard to reach, as are present for example in aircraft components through which a medium flows, in particular in heat exchangers, rinsing methods are generally used. Contamination having a low chemical potential, consisting of primarily nonpolar substances, can mainly be removed only mechanically. In many applications, aircraft components through which a medium flows are coated with carbon-containing lubricants, fuels or other carbon-containing substances during operation. Likewise, under specific conditions, substances from the surroundings, such as dust, sand, combustion products, oils, fuels or lubricants may accumulate. In the case of carbon-containing compounds, in particular coking and partial oxidation, which occurs in specific temperature ranges, are problematic. In the case of aircraft components through which a medium flows, such as heat exchangers, the internal volume of which usually comprise pronounced undercuts and large, contorted surfaces, owing to the construction thereof, it is often not possible to remove the contamination by means of conventional methods, owing to a lack of accessibility. Accordingly, the surfaces in the internal volume are in large part accessible only for rinsing methods or perfusion cleaning methods. However, cleaning in rinsing methods requires the use of strongly reactive acids or other powerful chemical cleaning agents.

If the contamination cannot be cleaned, owing to the inaccessibility or owing to the mechanical or chemical resistance, the aircraft components to be cleaned must even be replaced. Furthermore, long process time must sometimes be anticipated in the known cleaning methods. Using strongly reactive cleaning agents is also problematic with respect to occupational safety, environmental impact, or possible residues on the surfaces. This relates in particular to heat exchangers through which air flows, during operation, for air-conditioning purposes.

SUMMARY

An embodiment of the present invention provides a method that cleans surfaces in an internal volume of an aircraft component through which a medium flows. The method includes: connecting the internal volume to be cleaned to a steam generator; generating a cleaning steam having a predetermined vapour pressure and temperature by the steam generator; applying the cleaning steam to the surfaces to be cleaned in the internal volume; maintaining the vapour pressure and the temperature within the internal volume for the duration of a predetermined condensation time; generating a pressure drop in the internal volume of the aircraft component, in order to vaporise the portion of the cleaning steam that condensed during the condensation time; and removing the cleaning steam from the internal volume via a discharge device.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
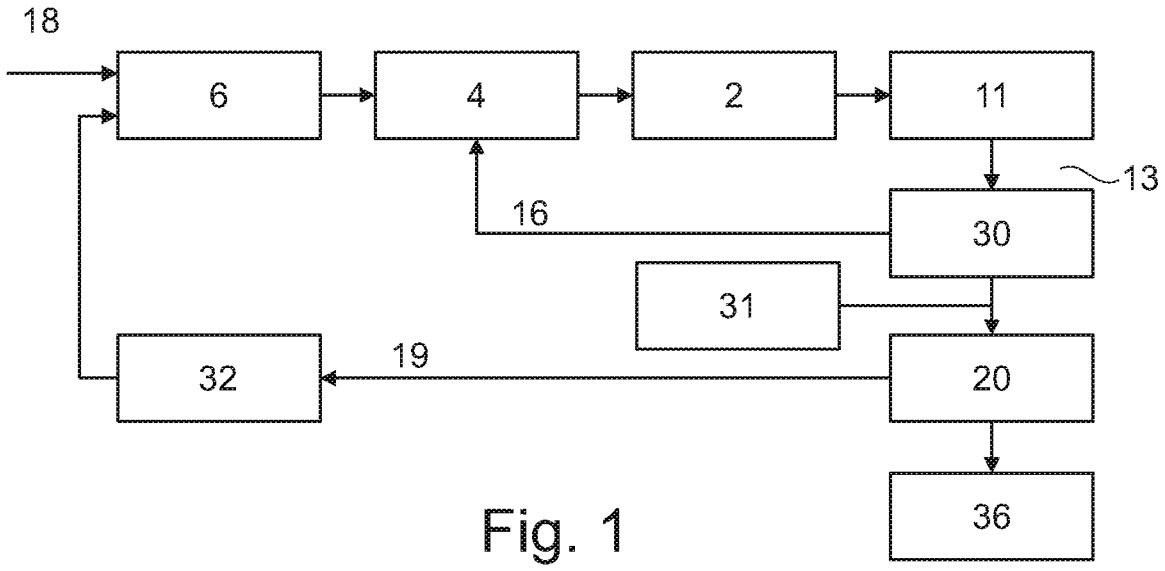
FIG. 1 schematically shows the setup for a method according to the invention for cleaning surfaces in the internal volume of an aircraft component through which a medium flows.

Embodiments of the present invention provide a cleaning method that allows for effective and gentle removal of mechanically and chemically resistant contamination from surfaces in the internal volume of an aircraft component through which a medium flows, which surfaces are difficult to access.

According to a concept of the present invention, a method for cleaning surfaces in the internal volume of an aircraft component through which a medium flows is provided, the method having at least the following steps: connecting the internal volume to be cleaned to a steam generator, generating a cleaning steam having a predetermined vapour pressure and temperature, by means of the steam generator, applying the cleaning steam to the surfaces to be cleaned in the internal volume of the aircraft component through which a medium flows, maintaining the vapour pressure and the temperature inside the internal volume for the duration of a predetermined condensation time, generating a pressure drop in the internal volume of the aircraft component through which a medium flows for vaporising the portion of the cleaning steam that has condensed during the condensation time, and removing the cleaning steam from the internal volume of the aircraft component through which a medium flows, by means of discharge device. This method makes it possible to clean contamination from surfaces that are difficult to access. For this purpose, cleaning steam or the condensate thereof is used as a cleaning medium. Applying the cleaning steam to the surfaces causes said steam to condense at suitably selected parameters, such as vapour pressure, temperature, vapour portion or condensation time, on the surfaces, and in particular on the contamination. In this case, the vapour condensate can penetrate into and form deposits in cracks, cavities and porosity of the contamination. As a result of generating a rapid pressure drop in the internal volume of the aircraft component through which a medium flows, the stored condensate is subsequently vaporised again. In this case, the phase change of the cleaning medium from fluid back into a gaseous state is associated with a rapid increase in volume of the cleaning medium. The vaporisation of the condensate deposited in and on the contamination generates locally high compression forces in the contamination, which forces lead to flaking and detachment of the contamination. This detached contamination can subsequently be removed, together with the cleaning steam, from the internal volume of the aircraft component through which a medium flows, through a discharge device. In comparison with mechanical methods, the method according to embodiments of the invention is gentle to the surfaces to be cleaned, since no material removal occurs on the base material, and furthermore the ecological and health impacts are reduced by omitting or minimising chemical cleaning agents.

Particularly preferably, the internal volume of the aircraft component through which a medium flows is rinsed with water following removal of the cleaning steam. As a result, the effect of the cleaning process can be increased, and its successful conclusion can be achieved. Further contamination is removed by means of one or more rinse cycles of the internal volume, by means of water, which rinse cycles follow the cleaning steps, which further contamination was detached from the surfaces by means of the vaporisation, but still remained in the internal volume of the aircraft component through which a medium flows while the cleaning steam was removed.

It is furthermore preferable for the cleaning steps to be repeated in a manner having a predetermined cycle time. Repeating the cleaning steps makes it possible to achieve efficient cleaning, the degree of contamination reducing at each subsequent cleaning cycle. In this case, particularly stubborn contamination can be removed in layers, since the vapour condensate does not have to penetrate the entirety of the contamination, as in a cleaning application, but rather detaches the topmost layers of the contamination, in each case, in each cleaning cycle. The times of the individual cleaning stages can thus be reduced.

It is furthermore preferable to use water vapour as the cleaning steam. Since the contamination removal is substantially implemented using mechanical forces, which result due to the rapid volume increase during the vaporisation, it is generally not necessary to provide particular chemical cleaning agents, such as highly reactive acids. Water vapour can be precisely controlled over a known and reproducible pressure and temperature range, and is also particularly suitable for cleaning surfaces in the internal volume of heat exchangers due to its harmlessness to health and ecology, in particular in the case of heat exchangers through which air flows for air-conditioning purposes. Depending on the type of contamination and the field of application of the aircraft component through which a medium flows, it may be advantageous to add chemical cleaning agents to the cleaning steam in order to improve the cleaning effect.

In order to achieve a good cleaning effect, it has been found that a cleaning steam preferably having temperatures of at least 388 Kelvin, at most 646 Kelvin, and ideally in the region of 433 Kelvin should be used. It is furthermore preferable for the vapour pressure of the cleaning steam to be at least 0.17 MPa, at most 22 MPa, and particularly preferably 0.61 MPa. A cleaning steam having a vapour portion of 80%, but at least 10%, is advantageous for an optimum cleaning effect. A saturated steam that is provided thereby allows for sufficient condensation during the cleaning. In this case, an application time of the condensate in the contamination that is in the region of a few minutes can increase the cleaning effect. However, depending on the type of contamination, this cycle time can also be just a few seconds, or up to an hour. In order to ensure sufficiently quick vaporisation of the condensate after a pressure drop has been generated, the pressure gradient should preferably be at least 0.01 MPa/s, and particularly preferably 0.1 MPa/s.

In a particularly advantageous embodiment, the method is performed using a steam generator, the vapour pressure and/or vapour temperature of which can be controlled. The cleaning effect depends substantially on the condensation ability of the cleaning steam. In the case of dry steam, i.e. superheated steam, the condensation ability is greatly limited, and it is even possible that the contamination may be baked on further. Since what is known as saturated steam can always be assigned a temperature and a vapour pressure, a suitable condensation ability can be set by means of said parameters. In particular, the method can thus be adjusted to various levels of pressure and temperature resistance of the surfaces to be cleaned.

In a particularly preferred embodiment, a further method step is provided, in which the removed cleaning steam is recycled, by means of being condensed and cleaned, and supplied to the steam generator for generating a cleaning steam again, in a subsequent cycle. Carrying out the cleaning method according to the invention, including return and recycling of the cleaning medium, reduces the costs of the cleaning process, since it is not necessary to provide a new unused cleaning medium for each cycle, and reduces the amount of used cleaning medium to be disposed of per cleaning process.

In a further preferred embodiment of the method according to the invention, an additional method step is provided, in which the removed cleaning steam passes through an aircraft component through which a medium flows, for the purpose of energy recovery, before it is again supplied to the steam generator. A portion of the thermal energy of the heated exhaust steam can therefore be used for steam generation again, in a subsequent cleaning cycle.

According to a particularly preferred embodiment of the cleaning method according to the invention, the pressure drop in the internal volume of the aircraft component to be cleaned is achieved by opening a discharge device. The vapour pressure is maintained during the condensation time by means of a virtually closed discharge device, which separates the internal volume from a region of lower pressure. Slightly opening the discharge device while at the same time maintaining the pressure allows for removal of excess condensate and prevents the undesired formation of relatively large accumulations of water, under pressure. A relatively large accumulation of water would reduce the achievable pressure gradient. Opening the discharge device suddenly reduces the pressure in the internal volume, as a result of which rapid vaporisation of the condensate is achieved and the cleaning steam is removed. In this case, it is particularly preferable for the discharge device to include a switch valve. For this purpose, the discharge device and the switch valve should have a suitable flow cross section, in order to generate a sufficiently large pressure gradient. Ideally, no air is present in the system during the method, in order for the heat transmission and cleaning effect to be optimised. This can be achieved in that, when pressure begins to be applied, the discharge device initially remains slightly open, in order to allow for the air to be displaced and blown out by the steam. Alternatively, the air can be suctioned out before pressure begins to be applied (vacuum).

Furthermore, it is preferable for the degree of contamination of the removed cleaning steam to be measured. The cleaning effect of the rinsing cycle can be inferred by analysing the degree of contamination and the type of contamination, and method parameters such as condensation time and vapour pressure can be adjusted for subsequent cycles. It is furthermore preferable to repeat the cleaning cycle until the measured degree of contamination reaches a predetermined threshold value, so that the cleaning can be ended.

In a further embodiment, the pressure loss during a cleaning process of a standardised comparison component (comparative value) is measured, and the cleaning cycle is repeated in an automated manner, until the measured pressure loss of the aircraft component to be cleaned substantially corresponds to the comparative value. In this case, a comparison component can ideally consist of a new or cleaned component that is structurally identical to the aircraft component to be cleaned. As a result of integrating the comparison component in the cleaning assembly, ideally in a parallel assembly, both aircraft components are exposed to the same cleaning conditions. Analysing the pressure loss during cleaning thus offers control of the cleaning result without having to perform tests in advance in order to set standard parameters of the different aircraft components. In this case, exact achievement of the comparative value does not have to be achieved as the end point of the method. The comparative value can also be formed by a previously specified tolerance range, which makes it possible to expect a cleaning level suitable for the functionality of the aircraft component through which a medium flows. A temporally limited end signal is also advantageous, such that the automated repetition of the cleaning cycles is stopped if the comparative value is not achieved within a previously defined maximum time. This prevents time-consuming cleaning of heavily contaminated components that cannot be cleaned any further and ultimately have to be replaced.

The invention will be further explained in the following in relation to exemplary embodiments and with reference to the accompanying drawings.

Figure 2:
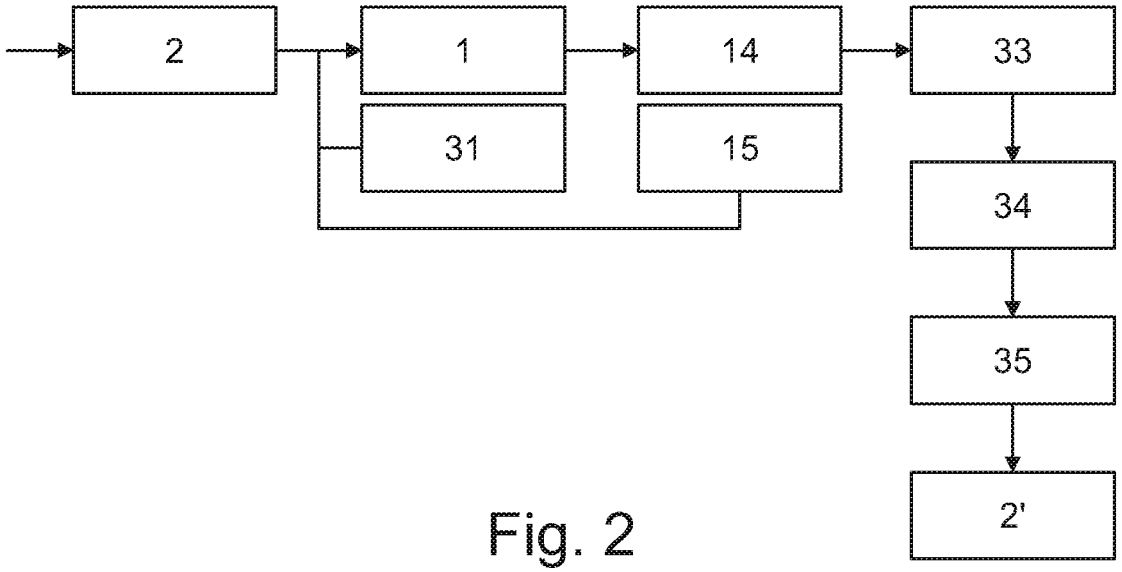
FIG. 2 schematically shows the process flow of a method according to the invention for cleaning surfaces in the internal volume of an aircraft component through which a medium flows.

FIG. 1 and FIG. 2 show, schematically and by way of example, the setup and the process flow of a cleaning method according to the invention. In this case, it is assumed in the following that the aircraft component 2 through which a medium flows, which component is to be cleaned, is a heat exchanger 2. This is not intended to be understood as a restriction, but instead the cleaning method according to the invention can be applied to a plurality of aircraft components 2 through which a medium flows, the internal volume of which components has surfaces to be cleaned. First of all, the surfaces to be cleaned are integrated into the cleaning assembly 1. In the case of surfaces to be cleaned in the internal volume of a heat exchanger 2, the heat exchanger 2 is connected to the cleaning assembly 1 by a suitable adaptation means 3. In this case, a steam generator 4 is provided in the cleaning assembly 1. The adaptation means 3 should form a pressure-resistant connection between the steam generator 4 and the internal volume of the heat exchanger 2 that is to be cleaned. A fluid cleaning medium, which generally consists mainly of water, is treated, in a step 6 preceding the cleaning, for the requirements of the surfaces to be cleaned. The preceding treatment 6 can consist, for example, in demineralisation of the fluid cleaning medium. In the following, the sequence of the cleaning method according to the invention will be explained on the basis of water as the cleaning medium; however the disclosure of this application is explicitly intended to also include other suitable cleaning media, in particular chemical cleaning agents or aqueous solutions of chemical cleaning agents.

The treated water is supplied to the steam generator 4, which causes the water to form steam. It is thus possible, for example, for a cleaning steam 7 under excess pressure to be generated by means of a supply of heat and a pump. In this case, the generation of the cleaning steam 7 is preferably controllable. In order to achieve a good cleaning effect, it has been found that a cleaning steam 7 having temperatures of at least 388 Kelvin, a vapour pressure of at least 0.17 MPa, and a vapour portion of at least 10% should be used. Ideally, the temperature should be approximately 433 Kelvin, the vapour pressure approximately 0.8 MPa, and the vapour portion approximately 80%. A saturated steam of this kind is advantageous for ensuring sufficient condensation during the cleaning.

In principle, it is also possible for dry steam, i.e. superheated steam, to be used, where the fact that the cleaning power is substantially lower and the contamination 9 may bake on and solidify further should be taken into account. In the range of the saturated steam, vapour pressure and temperature are always clearly assigned, with the result that a control can be adjusted by regulating the pressure and temperature.

The cleaning steam 7 generated in the steam generator 4 is subsequently applied to the surfaces to be cleaned in the internal volume of the heat exchanger 2. Applying the cleaning steam 7 to the internal volume of the heat exchanger 2, and heating the heat exchanger 2 to a suitable temperature is followed by a sufficiently long condensation time, in which the cleaning steam 7 can act on the surfaces to be cleaned, and can form a cleaning steam condensate 8 on the surfaces. In this case, the condensation also take place on the contamination 9.

In the next step, a significant pressure drop 10 is generated. This can be achieved for example by opening a switch valve 11 in a discharge device. The pressure gradient substantially determines the cleaning effect, since the pressure gradient determines the rapid vaporisation, and thus the speed of the volume expansion of the accumulated condensate 8 during the phase transition from liquid to solid is determined. In this case, the pressure gradient should be at least a rate of approximately 0.01 MPa/s, ideally approximately 0.1 MPa/s. Subsequently, the cleaning steam 7 together with the detached contamination 9 is removed through the opened discharge device.

The cleaning steps are repeated in a manner having a predetermined cycle time. Depending on the type of contamination 9, this can be between approximately 20 seconds and up to an hour, and is ideally a few minutes. In order to monitor the cleaning process, the exhaust stem 13, i.e. the ejected cleaning steam, is condensed and analysed. The cleaning effect and the successful completion of the cleaning process can be determined thereby. Following the cleaning steps, further rinsing processes 14, for example using water, can be provided, in order to remove detached contamination 9 which was detached by the cleaning steam 7 but has still remained in the internal volume of the heat exchanger 2. During the rinsing process 14 using water, in an analysis step 15 the pressure loss across the heat exchanger 2 can in addition be measured, as a further indicator for the degree of cleaning. Following the last rinsing process 14, the heat exchanger 2 is dried using steam 33, cooled open 34, and aired 35, and is then available as a cleaned heat exchanger 2'.

Energy recovery is provided for the cleaning method, as an optional step 16, which can be achieved by using a heat exchanger that is arranged between the discharge device and the water intake 18 of the heat exchanger 2, and which provides the heat, obtained from the exhaust steam 13, for the steam generation 4. The contaminated exhaust steam 13, or the contaminated exhaust water 13, can subsequently be disposed of 36. Furthermore, the exhaust steam 13 can be recycled, by means of a water recovery stage 19 being connected downstream of a steam-cleaning cycle, which water recovery is achieved for example by separating 20 the contamination 9 out of the exhaust water 13, filtering the water, and providing the water, thus treated, at the intake 18 of the steam generator 4.

Figure 3A:
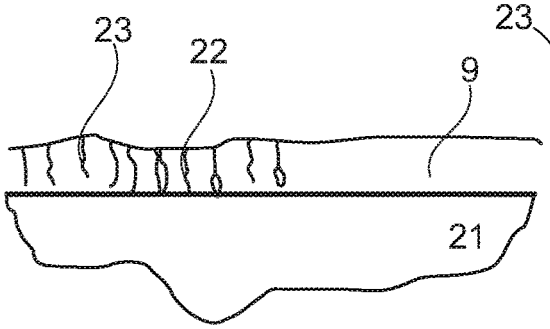
FIGS. 3*a*-3*d* schematically show the operating principle of the cleaning method according to the invention.
Figure 3B:
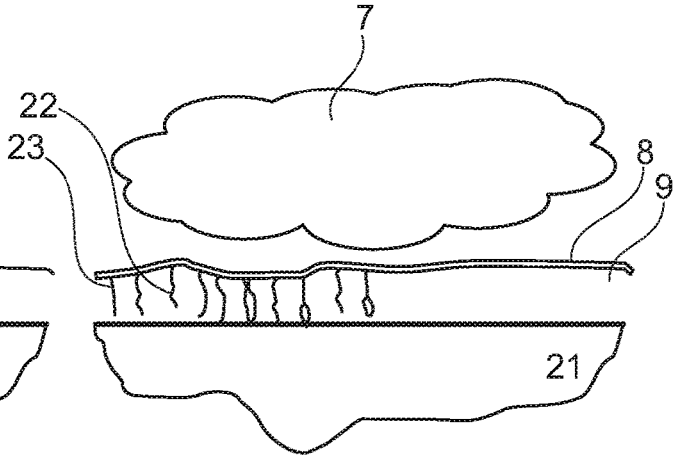
Figure 3C:
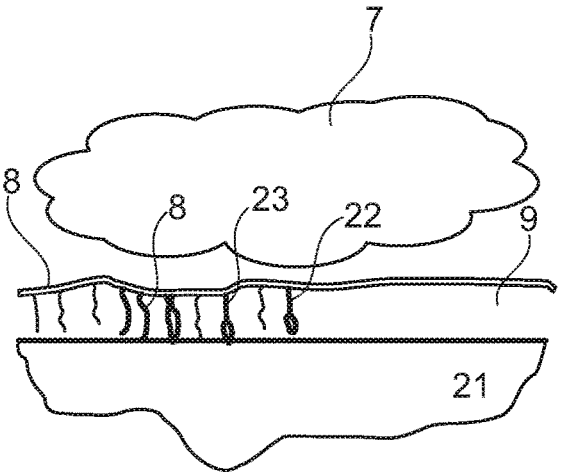
Figure 3D:
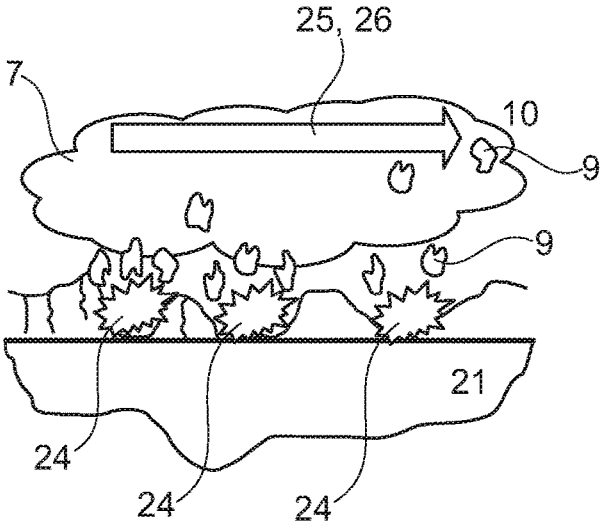

The mode of operation of the detachment of the surface contamination 9 is shown schematically in FIGS. 3*a* to 3*d*. The cleaning method according to the invention makes use of the natural consistency of the contamination 9 of the surfaces to be cleaned. The contamination 9 accumulates on the base material 21 of the surfaces to be cleaned, and is generally porous and has cavities 22 and cracks 23. During the cleaning method, the surfaces and the contamination 9 are subjected to the excess pressure and the cleaning steam 7 (FIG. 3*b*). During the condensation time, the cleaning steam 7 starts to condense on all the surfaces, and thus also on the contamination 9. In this case, the cleaning steam condensate 8 occupies the surfaces and, owing to the porosity of the contamination 9, begins to penetrate into cracks 23 and cavities 22 and accumulate there (FIG. 3*c*). In the next step, a pressure drop 10 is generated, which brings about sudden vaporisation, and thus an increase in volume, of the cleaning steam condensate 8 deposited in the contamination 9. The compression forces generated thereby, which forces act locally in the contamination 9, then lead to flaking and detachment 24 of the contamination 9. The increased volume flow 25 of the cleaning steam 7 additionally assists the removal 26 of the detached contamination 9 (FIG. 3*d*).

The cleaning according to the invention can be applied not only in the case of porous or solid contamination, but rather for example also liquid or viscous films can be removed. The operating mechanism described above, with reference to FIG. 3, can have a different appearance in the case of contamination other than the porous or solid contamination described.

Figure 4:
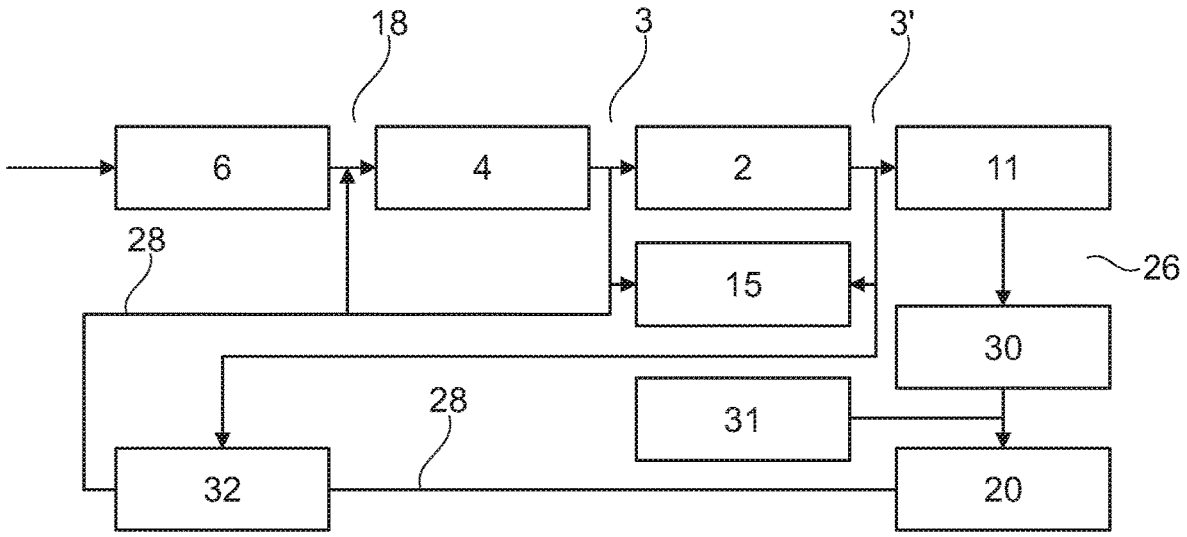
FIG. 4 schematically shows a further embodiment of a cleaning method according to the invention.

A specific manifestation of the cleaning method is described in FIG. 4. In this case, a heat exchanger 2 is connected to a pressure- and/or temperature-controllable steam generator 4 via a first adaptation means 3. The steam generator is supplied, at the water intake 18 thereof, with industrial water and treated water from a water circuit 28, by means of a demineralisation device 6. An outlet of the heat exchanger 2 to be cleaned is connected to a switch valve 11 via a second adaptation means 3'. The steam generator 4 builds up pressure in the heat exchanger 2. In the process, condensate 8 initially collects on the surfaces, which are at a lower temperature than that of the cleaning steam 7 generated. After a predetermined vapour pressure and/or temperature level is reached, this state is maintained for the duration of a defined condensation time. The condensation time can vary as required and, in the normal range, is from approximately half a minute to approximately an hour. Depending on the structure and composition of the contamination 9, as well as the duration of the condensation time in which the vapour pressure in the internal volume of the heat exchanger 2 is maintained, the condensate 8 is stored in the contamination 9. After the condensation time has expired, the switch valve 11 provided in the discharge device is fully opened, such that a large pressure drop 10 is established in the internal volume of the heat exchanger 2. Owing to the large pressure drop 10, the accumulations of vapour condensate 8 vaporise, significantly increasing in volume. In order for a sufficiently high pressure drop rate to be established, the discharge device, the switch valve 11 and downstream pipelines are provided with a sufficiently large flow cross section. In the case of an internal volume of a heat exchanger 2 that is to be cleaned and to which vapour pressure is applied, the internal volume being approximately 3 litres, for example DN12 flow tube cross sections have been found to be sufficient. For larger volumes to which pressure is applied, correspondingly larger flow tube cross sections are to be selected. In this case, the pressure loss across the heat exchanger 2 can be analysed 15. The vapour-condensate mixture 7, 8 escapes via the discharge device. The discharge device is fluidically connected to a condenser 30. The vapour-condensate mixture 7, 8 is removed 26 and supplied to the condenser 30, in which complete condensation of the removed exhaust steam 13 is intended to take place. At this point, it is advantageous to take samples of the condensed mixture and to examine 31 the samples with respect to contamination portions and the composition thereof, in order to be able to infer the cleaning effect. On the basis of the findings made in the step 31, the method parameters of the subsequent cleaning cycles can be effectively adjusted. The exhaust water 13 from a cleaning cycle is collected in a separation vessel 20, the contamination 9 being able to be separated according to the type, such that the cleaned water is supplied to the steam generator 4, via a water circuit 28 and water treatment 32 including filtration, and is thus returned to the process again.

In principle, the mechanical stresses owing to the pressure fluctuations and hydrodynamic forces in the internal volume of the heat exchanger 2 to be cleaned are to be taken into account. Heat exchangers 2 often have sensitive structures having low material wall thicknesses which can be damaged. However, owing to the significantly lower density of steam compared with fluids, the fluidic mechanical stresses in a steam cleaning method are lower than in a rinsing method.

While embodiments of the invention have been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A method for cleaning surfaces in an internal volume of an aircraft component through which a medium flows, the method comprising:

connecting the internal volume to be cleaned to a steam generator via a pressure-resistant adapter, generating a cleaning steam having a predetermined vapour pressure and temperature by the steam generator, applying the cleaning steam to the surfaces to be cleaned in the internal volume, maintaining the vapour pressure and the temperature within the internal volume for the duration of a predetermined condensation time, generating a pressure drop in the internal volume of the aircraft component, in order to vaporise the portion of the cleaning steam that condensed during the condensation time, and removing the cleaning steam from the internal volume via a discharge device.

2. The method according to claim 1, wherein the internal volume is rinsed with water following removal of the cleaning steam.

3. The method according to claim 1, wherein the steps are repeated in a manner having a predetermined cycle time.

4. The method according to claim 1, wherein water vapour is used as the cleaning steam.

5. The method according to claim 4, wherein the vapour pressure of the cleaning steam is between 0.17 mPa and 22 MPa.

6. The method according to claim 4, wherein the temperature of the cleaning steam is between 388 K and 646 K.

7. The method according to claim 4, wherein the pressure drop in the internal volume is at least 0.01 MPa/s.

8. The method according to claim 1, wherein the vapour pressure and/or the temperature of the steam generator is controllable.

9. The method according to claim 4, wherein the removed cleaning steam is recycled, by being condensed and cleaned, and supplied to the steam generator for generating the cleaning steam again, in a subsequent cycle.

10. The method according to claim 9, wherein the removed cleaning steam passes through a heat exchanger for energy recovery, before being supplied to the steam generator again.

11. The method according to claim 1, wherein the pressure drop in the internal volume is achieved by opening the discharge device.

12. The method according to claim 11, wherein the discharge device comprises a switch valve.

13. The method according to claim 1, wherein the degree of contamination of the removed cleaning steam is measured.

14. The method according to claim 13, wherein the cleaning cycle is repeated until the measured degree of contamination reaches a predetermined threshold value.

15. The method according to claim 1, wherein a pressure loss during a cleaning process of a standardised comparison component is measured providing a comparative value, and the cleaning cycle is repeated in an automated manner, until a measured pressure loss of the aircraft component to be cleaned substantially corresponds to the comparative value.

16. The method according to claim 7, wherein the pressure drop in the internal volume is at least 0.1 MPa/s.

* * * * *